US011043755B2

(12) United States Patent
Farzaneh et al.

(10) Patent No.: US 11,043,755 B2
(45) Date of Patent: Jun. 22, 2021

(54) ANTENNA ARRAY

(71) Applicant: GALTRONICS USA, INC., Tempe, AZ (US)

(72) Inventors: Sadegh Farzaneh, Kanata (CA); Des Bromley, Kanata (CA); Minya Gavrilovic, Kanata (CA); Farid Jolani, Kanata (CA); Amir Vaezi, Tempe, AZ (US); Mehdi Dadgarpour, Tempe, AZ (US)

(73) Assignee: GALTRONICS USA, INC., Tempe, AZ (US)

( * ) Notice: Subject to any disclaimer, the term of this patent is extended or adjusted under 35 U.S.C. 154(b) by 256 days.

(21) Appl. No.: 16/383,269

(22) Filed: Apr. 12, 2019

(65) Prior Publication Data

US 2019/0312337 A1 Oct. 10, 2019

Related U.S. Application Data

(63) Continuation-in-part of application No. 16/211,655, filed on Dec. 6, 2018.

(60) Provisional application No. 62/595,274, filed on Dec. 6, 2017, provisional application No. 62/647,989, filed on Mar. 26, 2018.

(51) Int. Cl.

| | |
|---|---|
| ***H01Q 1/24*** | (2006.01) |
| ***H01Q 19/18*** | (2006.01) |
| ***H01Q 21/06*** | (2006.01) |
| ***H01Q 21/30*** | (2006.01) |
| ***H01Q 21/26*** | (2006.01) |

(52) U.S. Cl.

CPC ..... *H01Q 21/26* (2013.01); *H01Q 1/246* (2013.01); *H01Q 19/18* (2013.01); *H01Q 21/062* (2013.01); *H01Q 21/30* (2013.01)

(58) Field of Classification Search

CPC ..... H01Q 21/26; H01Q 1/246; H01Q 21/062; H01Q 19/18; H01Q 21/30; H01Q 21/205; H01Q 15/14; H01Q 25/001; H01Q 19/185; H01Q 5/48

See application file for complete search history.

(56) References Cited

U.S. PATENT DOCUMENTS

| | | | | |
|---|---|---|---|---|
| 2015/0256213 | A1* | 9/2015 | Jan | H01Q 21/205 370/338 |
| 2017/0085289 | A1* | 3/2017 | Jan | H01Q 21/28 |
| 2017/0244176 | A1* | 8/2017 | Ming | H01Q 1/246 |

(Continued)

*Primary Examiner* — Dimary S Lopez Cruz
*Assistant Examiner* — Michael M Bouizza
(74) *Attorney, Agent, or Firm* — Brion Raffoul

(57) ABSTRACT

An antenna array is provided which may include different levels of antenna elements on the array. A first set of antenna elements are arranged on a first set of reflectors with the reflectors being arranged in a shape having corners. A second set of reflectors with a second set of antenna elements are mounted on the corners of the first set of reflectors. A third set of reflectors is arranged in another shape with a third set of antenna elements being on the faces of the third set of reflectors. The first and second set of reflectors and antenna elements are on a first level of the array and the third set of reflectors and antenna elements are on a second level of the array. The third set of reflectors and antenna elements are between the first level and the base plate of the array.

19 Claims, 8 Drawing Sheets

(56) References Cited

U.S. PATENT DOCUMENTS

| | | | | |
|---|---|---|---|---|
| 2018/0183134 | A1* | 6/2018 | Jan | H01Q 21/26 |
| 2018/0227775 | A1* | 8/2018 | Bisiules | H01Q 1/246 |

* cited by examiner

ANTENNA ARRAY

CROSS-REFERENCE TO RELATED APPLICATION(S)

This application is a Continuation-in-Part of U.S. patent application Ser. No. 16/211,655 filed on Dec. 6, 2018 which claims the benefit of U.S. provisional patent application Ser. No. 62/595,274, filed Dec. 6, 2017 and provisional patent application Ser. No. 62/647,989, filed Mar. 26, 2018, the entire contents of which are incorporated by reference herein.

TECHNICAL FIELD

The present disclosure generally relates to antenna, and more particularly relates to antenna arrays.

BACKGROUND

Antenna arrays having multiple antennas therein are often used to transmit and receive data to and from multiple sources. Cellular tower antennas, for example, are often in communication with numerous cellular phones or other electronic devices. Electronic devices may be capable of utilizing multiple communication protocols such as 3G, 4G, 5G, or the like, to communicate with an antenna array. Often, a single antenna array is designed to be capable of handling the different communication protocols which may use different frequency bands.

BRIEF SUMMARY

The present invention provides an antenna array is provided which may include different levels of antenna elements on the array. A first set of antenna elements are arranged on a first set of reflectors with the reflectors being arranged in a shape having corners. A second set of reflectors with a second set of antenna elements are mounted on the corners of the first set of reflectors. A third set of reflectors is arranged in another shape with a third set of antenna elements being on the faces of the third set of reflectors. The first and second set of reflectors and antenna elements are on a first level of the array and the third set of reflectors and antenna elements are on a second level of the array. The third set of reflectors and antenna elements are between the first level and the base plate of the array. The boresight of the second set of antenna elements is offset from the boresight of the third set of antenna elements.

In one aspect of the invention, there is provided an antenna array, comprising:

a first plurality of reflectors, each of the first plurality of reflectors having a face, a first edge and a second edge, wherein the first edge of each of the first plurality of reflectors is coupled to the second edge of another of the first plurality of reflectors;

a first plurality of antenna elements arranged on the face of at least one of the first plurality of reflectors, the first plurality of antenna elements configured to radiate within a first frequency band;

a second plurality of reflectors, the second plurality of reflectors mounted to an end of the first plurality of reflectors;

a second plurality of antenna elements arranged on a face of at least one of the second plurality of reflectors, the second plurality of antenna elements configured to radiate within a second frequency band different than the first frequency band;

a third plurality of reflectors, the third plurality of reflectors being mounted on the array such that the third plurality of reflectors are between the first plurality of reflectors and a base plate of the antenna array;

a third plurality of antenna elements, the third plurality of antenna elements being arranged on the face of at least one of the third plurality of reflectors, the third plurality of antenna elements being configured to radiate within a third frequency band different than the first frequency band and the second frequency band;

wherein the first plurality of antenna elements and the second plurality of antenna elements are at a first level of the antenna array and the third plurality of antenna elements are at a second level of the antenna array, the first level being different from the second level and the second level being between the first level and the base plate of the antenna array;

a boresight of said second plurality of antenna elements is at an angle from a boresight of the third plurality of antenna elements.

In another aspect of the present invention, there is provided an antenna array, comprising:

a first plurality of reflectors arranged in a first shape, the shape comprising at least two faces and at least two edges;

a first plurality of dipole antennas arranged on the at least two faces of the first plurality of reflectors, the first plurality of dipole antennas configured to radiate within a first frequency band;

a second plurality of reflectors arranged at the at least two edges of the first plurality of reflectors;

a second plurality of dipole antennas arranged on a face of at least one of the second plurality of reflectors, the second plurality of dipole antennas being configured to radiate within a second frequency band different than the first frequency band;

a third plurality of reflectors arranged in a second shape, the second shape comprising at least two faces and at least two edges;

a third plurality of dipole antennas arranged on a face of at least one of the third plurality of reflectors, the third plurality of dipole antennas configured to radiate within a third frequency band different than the first frequency band and the second frequency band;

wherein the first plurality of antenna elements and the second plurality of antenna elements are at a first level of the antenna array and the third plurality of antenna elements are at a second level of the antenna array, the first level being different from the second level and the second level being between the first level and a base plate of the antenna array;

a boresight of said second plurality of antenna elements is at an angle from a boresight of the third plurality of antenna elements.

BRIEF DESCRIPTION OF THE DRAWINGS

The detailed description will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or detail of the following detailed description.

There are sometimes size restrictions relative to the size (e.g., height and width) of an antenna array depending upon where the antenna array is to be installed. When numerous communication protocols, and thus numerous frequency bands, have to be handled by a single antenna, it can be difficult to fit all of the required antenna elements within the single antenna array. An antenna array including an arrangement of antenna elements which are interleaved in an azimuth plane is discussed herein. As discussed in further detail below, the arrangement allows more antenna elements to be placed within a given area, which allows for omni-directional performance across multiple frequency bands within a smaller antenna array.

Figure 1:
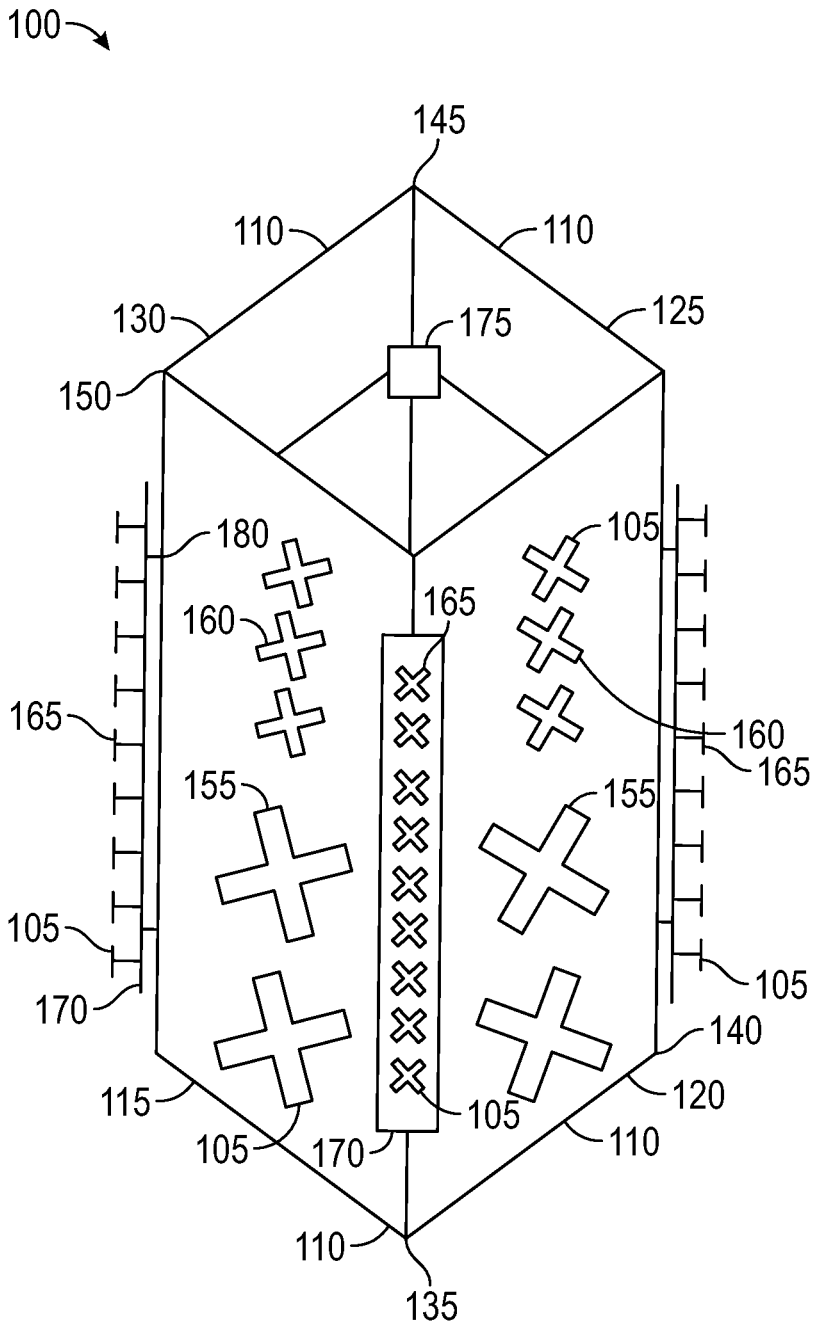
FIG. 1 is a perspective view of an antenna array, in accordance with an embodiment.

FIG. 1 is a perspective view of an antenna array 100, in accordance with an embodiment. The antenna array 100 may be used, for example, as a cellular phone tower antenna, satellite communication antenna, a radar antenna, or the like. The antenna array 100 includes multiple antenna elements 105. The antenna elements 105 may be, for example, dipole antennas, monopole antennas, patch antennas, folded dipole antennas, or the like, and any combination thereof. In the embodiment illustrated in FIG. 1, the antenna elements 105 are illustrated as dual-polarized dipole antennas, however, the number of antenna elements 105, the configuration of the antenna elements 105, and the type of antenna elements 105 can vary. The size of certain portions of the antenna element 105 control the frequency range that the antenna elements 105 operate over. For example, when the antenna element 105 is a dipole antenna, the length of the dipole arms control the frequency range over which the dipole antenna can operate. As seen in FIG. 1, the antenna array may include multiple different sized antenna elements 105 which allows the antenna array to operate over a different frequency ranges. By operating over multiple frequency ranges, the antenna array 100 can service different communication protocols (e.g., 3G, 4G, 5G, etc.) while also increasing the available bandwidth of the antenna array 100.

The antenna array 100 further includes multiple reflectors 110 which form the internal structure of the antenna array 100. The reflectors 110 may be formed from any conductive material. The reflectors 110 may be galvanically connected to one another, galvanically isolated from one another, or a combination thereof. In the embodiment illustrated in FIG. 1, the antenna array includes four reflectors 110 connected in a square or diamond pattern. However, the antenna array 100 may include two or more reflectors 110 arranged in any shape. For example, three reflectors 110 may be arranged in a triangle formation, five reflectors 110 may be arranged in a pentagonal formation, six reflectors 110 may be arranged in a hexagonal formation, and the like. While the above examples cite to regular shapes (i.e., triangles, squares, etc.), the reflectors 110 may be arranged in any regular or irregular shape.

The number of reflectors 110 may depend upon the number of frequency bands the antenna array 100 is intended to cover and the desired bandwidth of the antenna array 100. In general, the more antenna elements 105 that can be arranged inside of an antenna array 100, the more bandwidth the antenna array may cover. Furthermore, in order to achieve an omni-directional radiation pattern, antenna elements 105 generally should be arranged on multiple sides of the antenna array 100.

As discussed above, size restrictions may be placed upon an antenna array 100 which may limit the height and width of the antenna array 100. The size restrictions would generally limit the size of the reflectors 110, and thus the number of antenna elements 105 that could be placed inside the antenna array 100. Size restrictions can also be limiting with respect to the number of frequency bands the antenna array 100 can cover. These limitations can prevent an antenna array from having a functional omni-directional pattern across all of the frequency bands used therein.

In order to overcome limitations in size, to increase the number of antenna elements 105 within the antenna array 100, and/or to increase the number of frequency bands available to the antenna array 100, the antenna array 100 includes antenna elements 105 which are mounted on the face of the reflectors 110 and antenna elements 105 which are mounted on at the corners of the reflectors 110. In the example illustrated in FIG. 1, the antenna array 100 includes four faces 115, 120, 125 and 130, with each of the faces being a reflector 110, and four corners 135, 140, 145 and 150 where the reflectors 110 meet. As discussed above, the reflectors 110 may be galvanically connected to one another, galvanically isolated from one another, or any combination thereof. While not illustrated in FIG. 1, the antenna array may include structure to hold the reflectors in place and either galvanically couple or isolate them as needed for the particular antenna array.

As seen in FIG. 1, antenna elements 155 and 160 are arranged on one of the faces of the antenna array 100 and antenna elements 165 are arranged on one of the corners of the antenna array 100. By arranging antenna elements 105 on the faces 115-130 as well as the corners 135-150, the antenna elements 105 are interleaved in both azimuth and elevation planes. In other words, the antenna elements 155 and 160 are mounted on the reflectors at a first angle relative to the angle of the reflectors (i.e., an angle of zero as they are mounted flat upon each reflector), and the antenna elements 165 are mounted on the reflectors at a second angle relative to the angle of the reflectors 110. The angle that the antenna elements 165 are mounted may vary depending upon the number of reflectors 110. In the embodiment illustrated in FIG. 1, the antenna elements 165 may be mounted at a forty-five-degree angle relative to either of the reflectors 110 the antenna element 165 is mounted to.

The antenna elements 165 which are arranged at the corners 135-150 of the reflectors 110 may have to be compensated for their position. Adjustments to the length of the radiating elements (e.g., dipole arms, etc.), the dimensions of a parasitic element if used, the width and/or length of a balun, and the like, may be made to compensate for the position of the antenna elements 165.

The antenna elements 165 which are arranged on the corners 135-150 of the reflectors 110 may be mounted on a feed board 170. The feed board 170 receives a radio frequency signal and splits the signal that will be sent to each antenna element 165. The feed board 170 includes transmission lines which are distributed such that each antenna element 165 receives equal power and that the phase of the radio frequency signal is appropriate for the antenna element 165. For example, when the antenna element 165 is a dual polarized dipole antenna, as illustrated in FIG. 1, the feed board 170 provides each dipole of the dual-polarized dipole antenna with the proper phase. Likewise, each feed board 170 may receive the radio signal from a splitter 175 providing equal power and phase to each feed board 170. The feed boards 170 may be mounted to the reflectors via non-conductive standoffs 180. The non-conductive standoffs 180 may be made from, for example, plastic, or any other non-conductive material. While only the antenna elements 165 are illustrated as being mounted on feed boards, any of the antenna elements 105 may be mounted on a feed board to aid in the distribution of the radio frequency signals.

Figure 2:
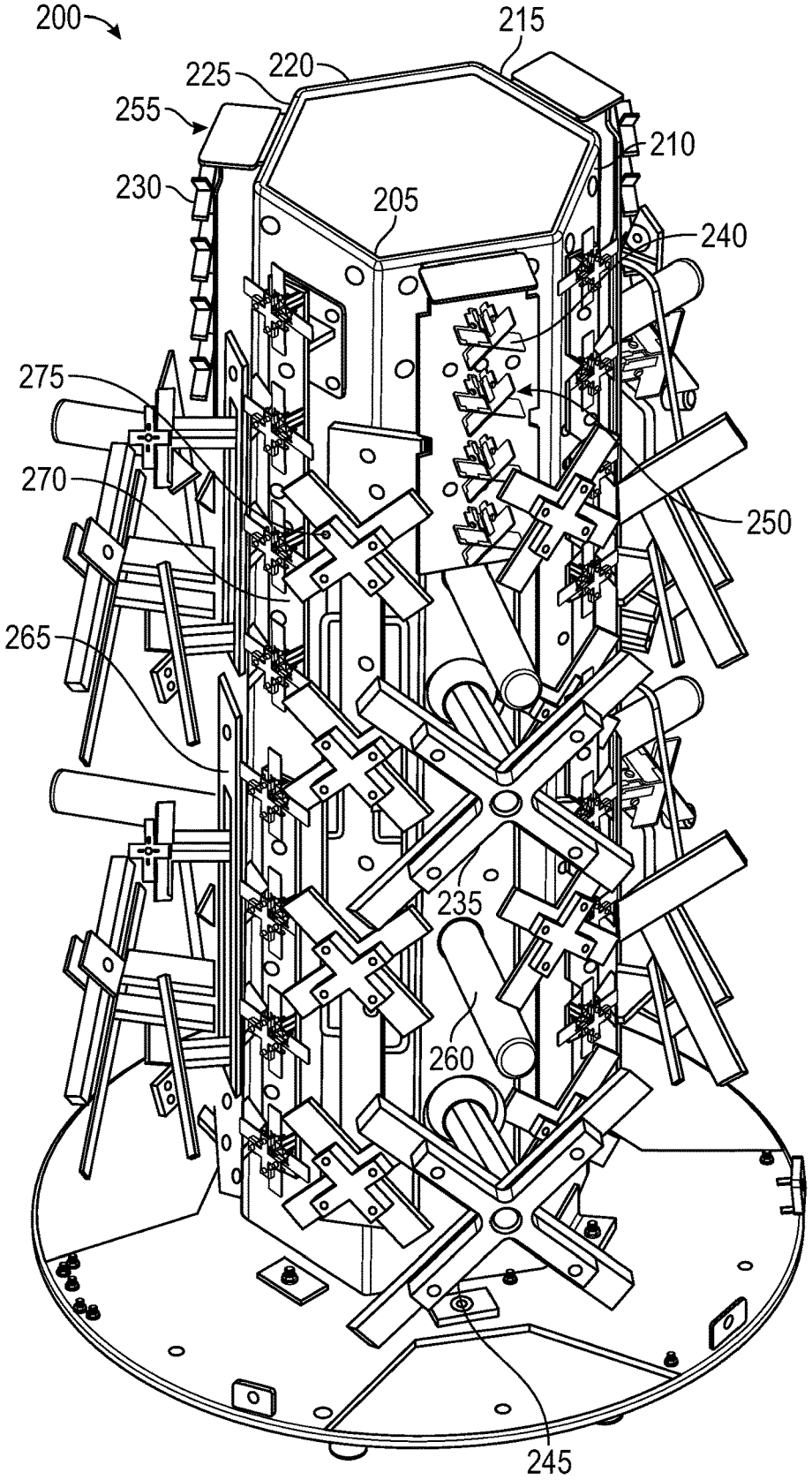
FIG. 2 is a perspective view of an antenna array, in accordance with an embodiment.

FIG. 2 is a perspective view of an antenna array 200, in accordance with an embodiment. The antenna array 200 includes reflectors 205, 210, 215, 220, 225 and 230 arranged in a hexagon formation. The antenna array 200 is intended to provide omni-directional coverage for all of the antenna elements therein. However, the antenna array architecture discussed herein could be used in directional antenna arrays as well. In order to provide omni-directional radiation pattern, identical antenna elements are formed on reflectors 205, 215 and 225. Likewise, identical antenna elements are formed on reflectors 210, 220 and 230.

The reflectors 205, 215 and 225 include dipole antennas 235 and 240. In the embodiment illustrated in FIG. 2, each reflector 205, 215 and 225 includes two dual-polarized dipole antennas 235. The dipole antennas 235 may operate over a frequency range of, for example, 698-960 MHz. As seen in FIG. 2, each dipole antenna 235 includes a parasitic element 245. The parasitic element 245 may broaden the frequency range over which the dual-polarized dipole antenna 235 can operate. The dipole antennas 235 may be fed, for example, via electromagnetic coupling or the like. In the embodiment illustrated in FIG. 2, each reflector 205, 215 and 225 includes four dual-polarized dipole antennas 240. The dipole antennas 240 are mounted on a feed board 250 which feeds the dual-polarized dipole antennas 240 as discussed above. The dual-polarized dipole antennas 240 may operate over, for example, a frequency range of 5150-5925 MHz. The antenna array 200 may further include a conductive fence 255 mounted at the top of the feed board 250. The conductive fence 255 may be used, for example, to improve an elevation sidelobe for the dual-polarized dipole antennas 240. The reflectors 205, 215 and 225 may further include one or more non-conductive posts 260. The non-conductive posts 260 may support a radome (not illustrated) which covers the antenna array 200 and prevents the radome from hitting any of the antenna elements therein.

The reflectors 210, 220 and 230 may each include eight dual-polarized dipole antennas 265. The dipole antennas 265 may operate over, for example, a frequency range of 3550-3700 MHz. The eight dual-polarized dipole antennas 265 may be mounted on two feed boards 270 which feed the dual-polarized dipole antennas 265.

The antenna array 200 further includes dual-polarized dipole antennas 275 which are mounted at the edges of the reflectors 205-230. In other words, the dual-polarized dipole antennas 275 are mounted at the boundary between two of the reflectors 205-230. In the embodiment illustrated in FIG. 2, the dual-polarized dipole antennas 275 are mounted on all six edges of the reflectors 205-230. By mounting the dual-polarized dipole antennas 275 at the edges of the reflectors 205-230, the number of antenna elements within the antenna array 200 can be increased without having to increase the size of the antenna array. In other words, unlike other array designs which either increase a number of reflectors, and thus a width of the antenna array, or lengthen their reflectors to mount more antenna elements on the face of the reflectors, the antenna array 200 can include more antenna elements within a smaller package. The dual-polarized dipole antennas may operate over a frequency range of, for example, 1695-2400 MHz. The dual-polarized dipole antennas 275 may be mounted on feed boards 280 and fed signals in a similar way as discussed above.

While the antenna array 200 is described as covering four frequency bands (i.e., 698-960 MHz, 1695-2400 MHz, 3550-3700 MHz and 5150-5925 MHz), the number of frequency bands and their exact frequency ranges can vary depending upon the needs of the antenna array 200 by increasing, or decreasing, the number of antenna elements and by adjusting the operating frequency thereof.

In one embodiment, for example, the antenna array 200 may utilize twelve input/output (I/O) ports to cover the four bands. For example, two I/O ports may cover the 698-960 MHz band, four I/O ports may cover the 1695-2400 MHz band, four I/O ports may cover the 3550-3700 MHz band, and two I/O ports may cover the 5150-5925 MHz band. Each I/O port offers an omni-directional pattern which is obtained by combining three sectors (i.e., antenna elements on different reflectors or edges). Each sector of each band has four antenna elements in elevation plane except the 698-960 MHz band which has two elements. Each of the sets of dual-polarized dipoles are in group of four which are fed with a four-way splitter with proper phase and amplitude difference. To make omnidirectional pattern the three panels are combined with a three-way splitter with equal power and phase. As can be seen dipoles for 698-960 MHz, 1695-2400 MHz, and 3550-3700 MHz bands are in close proximity. The antenna array 200 illustrated in FIG. 2, for example, can be housed within a cylinder having a fourteen-inch diameter. As discussed above, the different dipole elements are interleaved in the azimuth and elevation planes.

Figure 3:
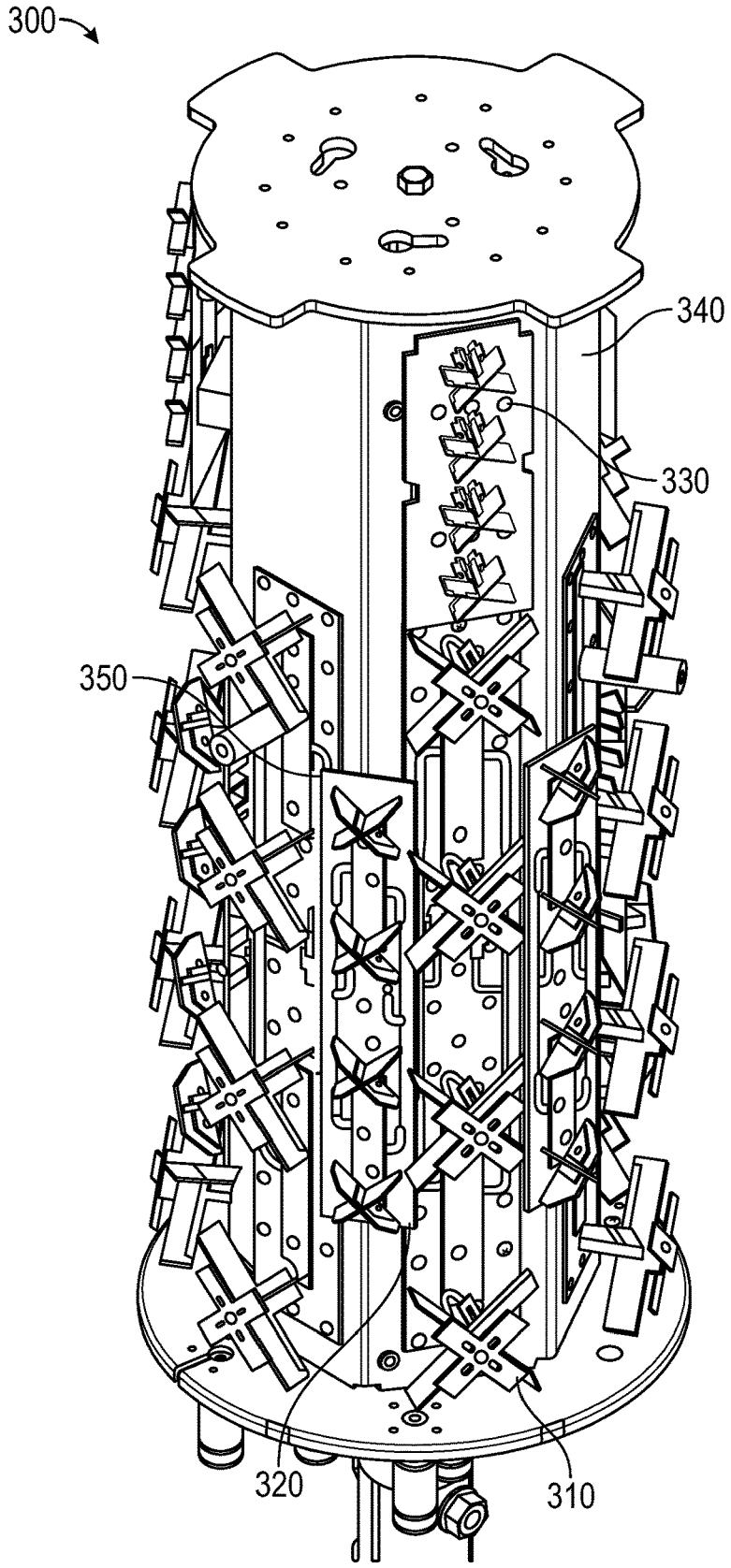
FIG. 3 is a perspective view of another antenna array, in accordance with an embodiment.

FIG. 3 is a perspective view of another antenna array 300, in accordance with an embodiment. Like the antenna arrays 100 and 200, the antenna array 300 includes antenna elements mounted on the face of reflectors and antenna elements mounted at the edges of reflectors.

The antenna array is made with dual-polarized dipoles 310 operating in the 2 GHz range (1695-2690 MHz), dual-polarized dipoles 320 operating in the 3.5 GHz range (3550-3700 MHz), and dual-polarized dipoles 330 operating in the 5 GHz range (5150-5925 MHz). As seen in FIG. 3, the dual-polarized dipoles 310 are mounted on all six of the faces of the reflectors 340 and the dual-polarized dipoles 320 are mounted on all six of the edges of the reflectors 340 on feed boards 350. In one embodiment, for example, the dual-polarized dipoles 320 may be mounted at an angle of sixty-degrees relative to the adjacent reflectors 340.

In the embodiment illustrated in FIG. 3, the antenna array 300 includes ten ports covering the three bands. However, the number of ports and the number of antenna elements can vary. In this embodiment, the antenna array 300 includes four-ports covering the 1695-2690 MHz band, four-ports covering the 3550-3700 MHz band, and two-ports covering the 5150-5925 MHz band. Each antenna port offers an omni-directional pattern which is obtained by combining three sectors (e.g., three reflectors, three edges, etc.). Each sector of each band has four antenna elements in elevation plane. In other words, two dual-polarized antennas, each having two dipoles, on three opposing reflectors comprise each sector. The opposing reflectors may be each separated by, for example, one-hundred twenty degrees. The two dual-polarized antennas are fed with a four-way splitter with proper phase and amplitude difference. To make omnidirectional pattern the three panels are combined with a 3-way splitter with equal power and phase. As can be seen dipoles for 1695-2690 MHz, and 3550-3700 MHz bands are in close proximity. The antenna array 300 illustrated in FIG. 3, for example, can be housed within a cylinder having a less than ten-inch diameter. As discussed above, the different dipole elements are interleaved in the azimuth and elevation planes.

One benefit of the embodiment illustrated in FIG. 3 is that by mounting the dual-polarized dipoles 320 on the edges of the reflectors 305, where the dual-polarized dipoles 310 are mounted, reduces the size of the antenna array 300 relative to antenna arrays which only mount antenna elements on the face of the reflectors. This leaves enough room within a size constrained antenna array (e.g., no more than two feet tall), to have the dual-polarized dipoles 330 isolated from the other antenna elements on the reflectors, which improves the radiation pattern of the dual-polarized dipoles 330.

Figure 4:
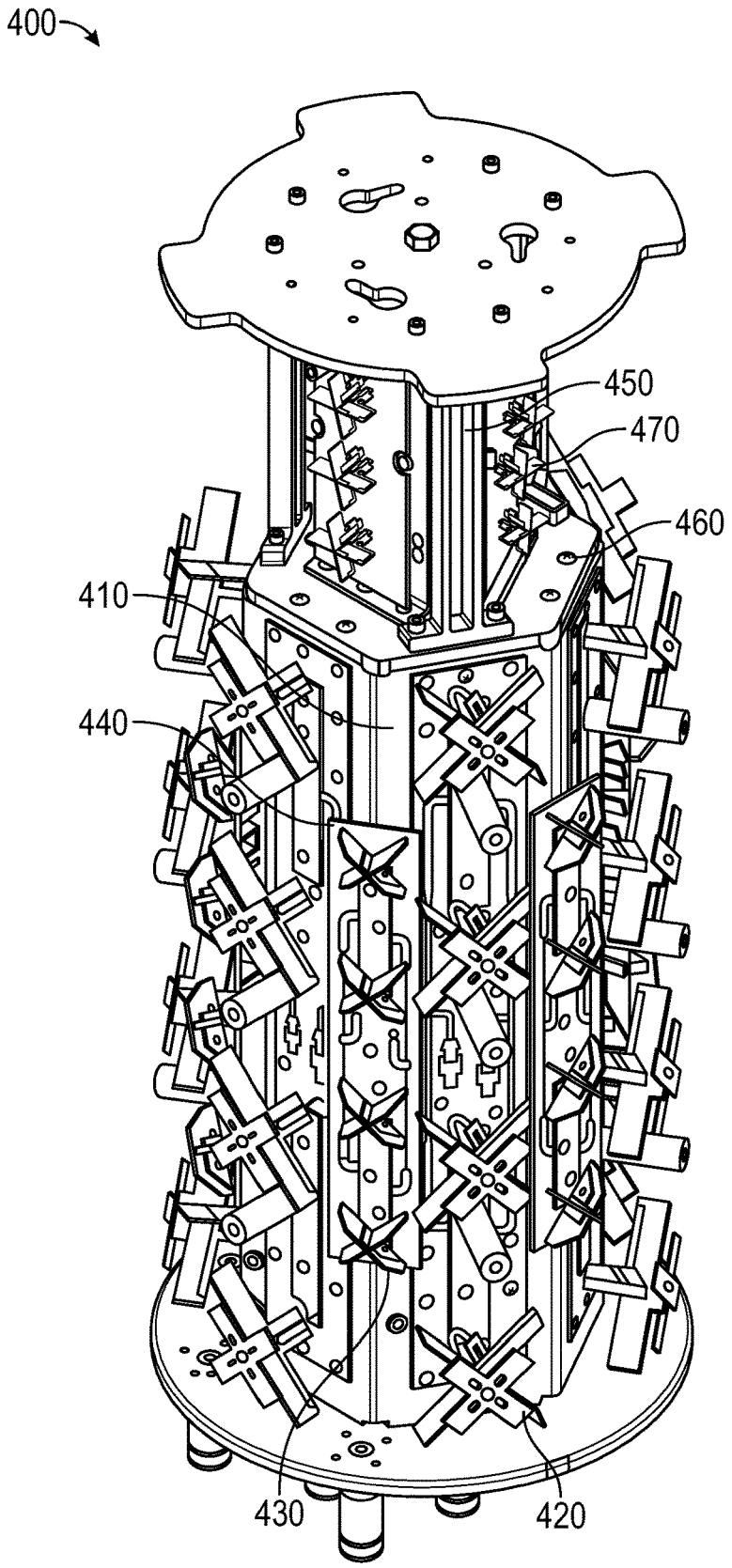
FIG. 4 is a perspective view of another antenna array, in accordance with an embodiment.

FIG. 4 is a perspective view of another antenna array 400, in accordance with an embodiment. The antenna array 400 is similar to the antenna array 300 illustrated in FIG. 3, but utilizes two different sized reflectors, as discussed below. The antenna array 400 includes six reflectors 410 arranged in a hexagonal formation. Antenna elements 420 are mounted on the face of each of the reflectors. In this embodiment, the antenna elements 420 are dual-polarized dipole antennas. The antenna array further includes antenna elements 430 mounted at the edges of the reflectors 410. Like the embodiments discussed above, the antenna elements 430 may be mounted on feed boards 440 which may be connected to the reflector edges using non-conductive standoffs.

Each of the reflectors 410 may have a width based upon the size of the antenna elements mounted thereon, namely, the antenna elements 420. In other words, the size of the reflectors 410 is based upon the frequency range of the antenna elements 420 thereon. In one embodiment, for example, the antenna array 400 may need better than twenty decibels coupling between adjacent elements. In this exemplary embodiment, in order to have better than twenty decibels coupling between adjacent elements, the width of the reflectors may around 0.6-0.8λ, or in this example, around eighty millimeters.

The antenna array 400 further includes reflectors 450. As seen in FIG. 4, the antenna array 400 includes three reflectors 450 arranged in a triangular configuration. The reflectors 450 are mounted on top of the reflectors 410 via a mounting plate 460. The antenna array 400 further includes antenna elements 470 mounted on the face of the reflectors 450. The size of the reflectors 450 is based upon the operating frequency range of the antenna elements 470. In other words, if the antenna1 elements 470 operate in the 5 GHz range, the reflectors 450 would be sized in width to properly reflect frequencies in that range. In one embodiment, for example, the antenna array 400 may need better than twenty decibels coupling between adjacent elements. In this exemplary embodiment, in order to have better than twenty decibels coupling between adjacent elements, the width of the reflectors 450 may around 0.6-0.8λ, or in this example, around fifty millimeters.

Figure 5:
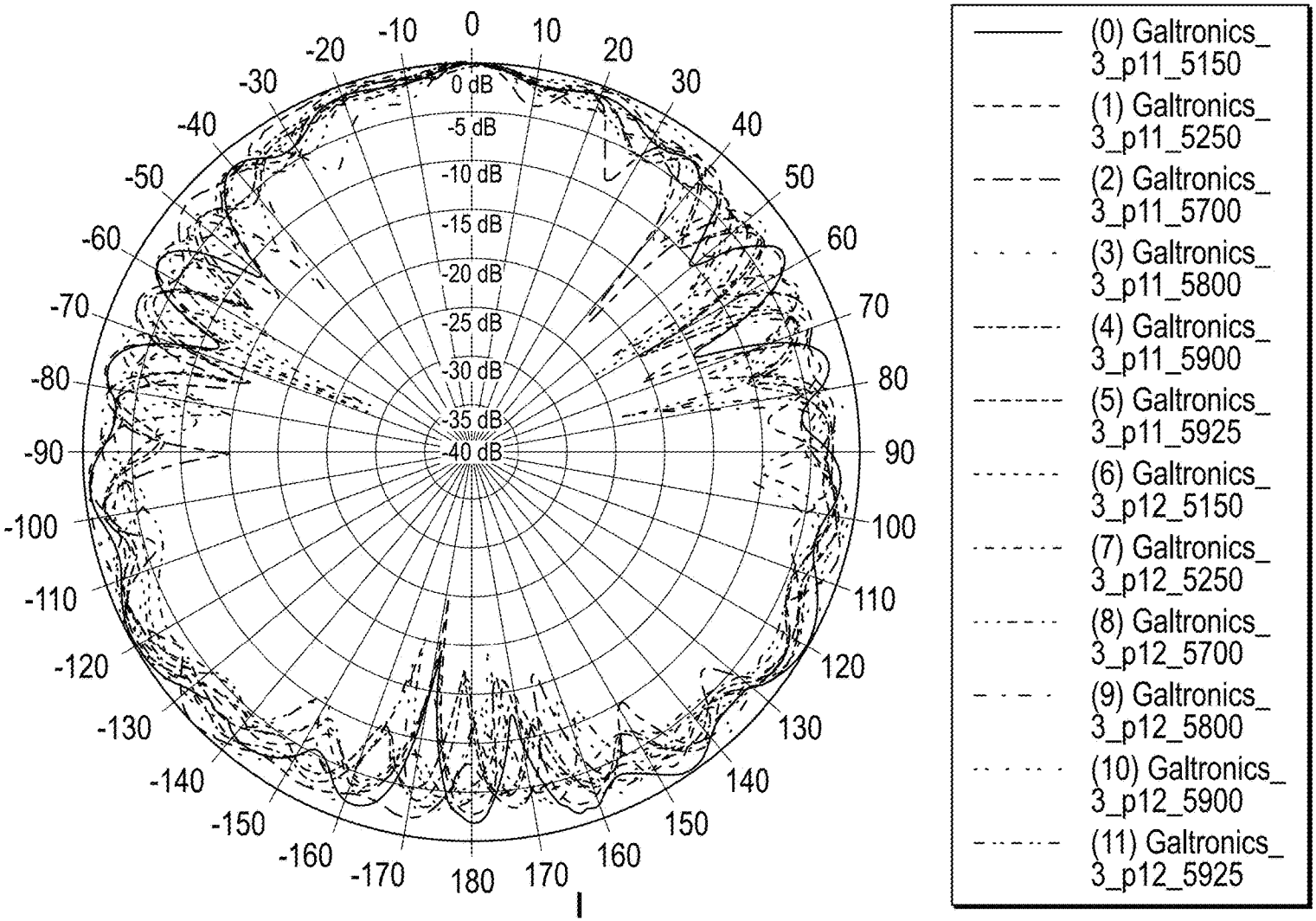
FIGS. 5 and 6 are polar plots illustrating the radiation patterns for antenna arrays, in accordance with an embodiment.
Figure 6:
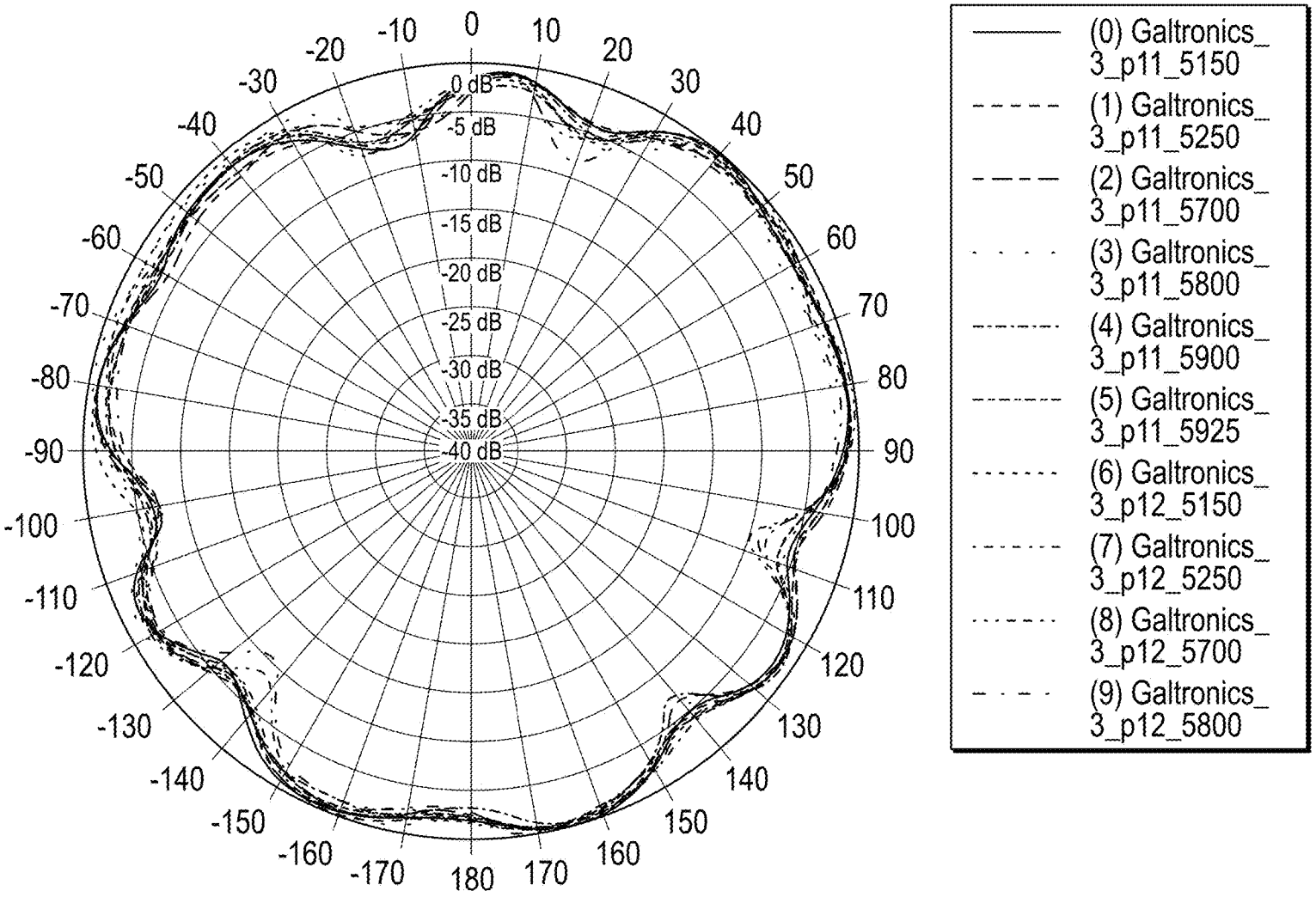

As discussed above, because the antenna elements 430 are mounted at the corners of the reflectors 410, the overall size of the antenna array 400 is reduced as the antenna elements 430 would otherwise need to be mounted on separate reflectors adjacent to the antenna elements 420 (i.e., the antenna array would be wider as there would be more reflectors), or placed on the reflectors above or below the antenna elements 420 (i.e., the antenna array would be taller as the reflectors 410 would need to be longer to fit the antenna elements 430 on the faces thereof). Accordingly, by arranging the antenna elements 430 at the corner of the reflectors, there is space within a predefined requirement (e.g., a limit of two feet tall), to fit the antenna elements 470 on the separate reflectors 450. By having reflectors of two sizes, the omni-directional pattern for the antenna elements 470 is improved. FIGS. 5 and 6 are polar plots illustrating the radiation patterns for antenna arrays 300 and 400, respectively. As seen in FIGS. 5 and 6, by including the reflectors 450 which are sized for the antenna elements 470, the nulls for the antenna array 400 illustrated in FIG. 6 are much smaller than the nulls for the antenna array 300 illustrated in FIG. 5. In other words, the antenna array 400 has a better omni-directional pattern across all of the frequency bands.

Returning to FIG. 4, while the reflectors 410 are arranged in a hexagon pattern (i.e., six reflectors) and the reflectors 450 are arranged in a triangular pattern (i.e., three reflectors), the number of reflectors in each sector can vary depending upon the needs of the antenna array. In other words, the number of sectors (i.e., the number of differently sized reflector sections), and the number of reflectors in each sector can vary depending upon the desired number of frequency bands in the antenna array, the desired bandwidth of the antenna array, and any size constraints for the antenna array. Furthermore, any of the reflector sectors may have antenna elements arranged at the junction of multiple reflectors (i.e., arranged at the corners), as discussed above.

Figure 7:
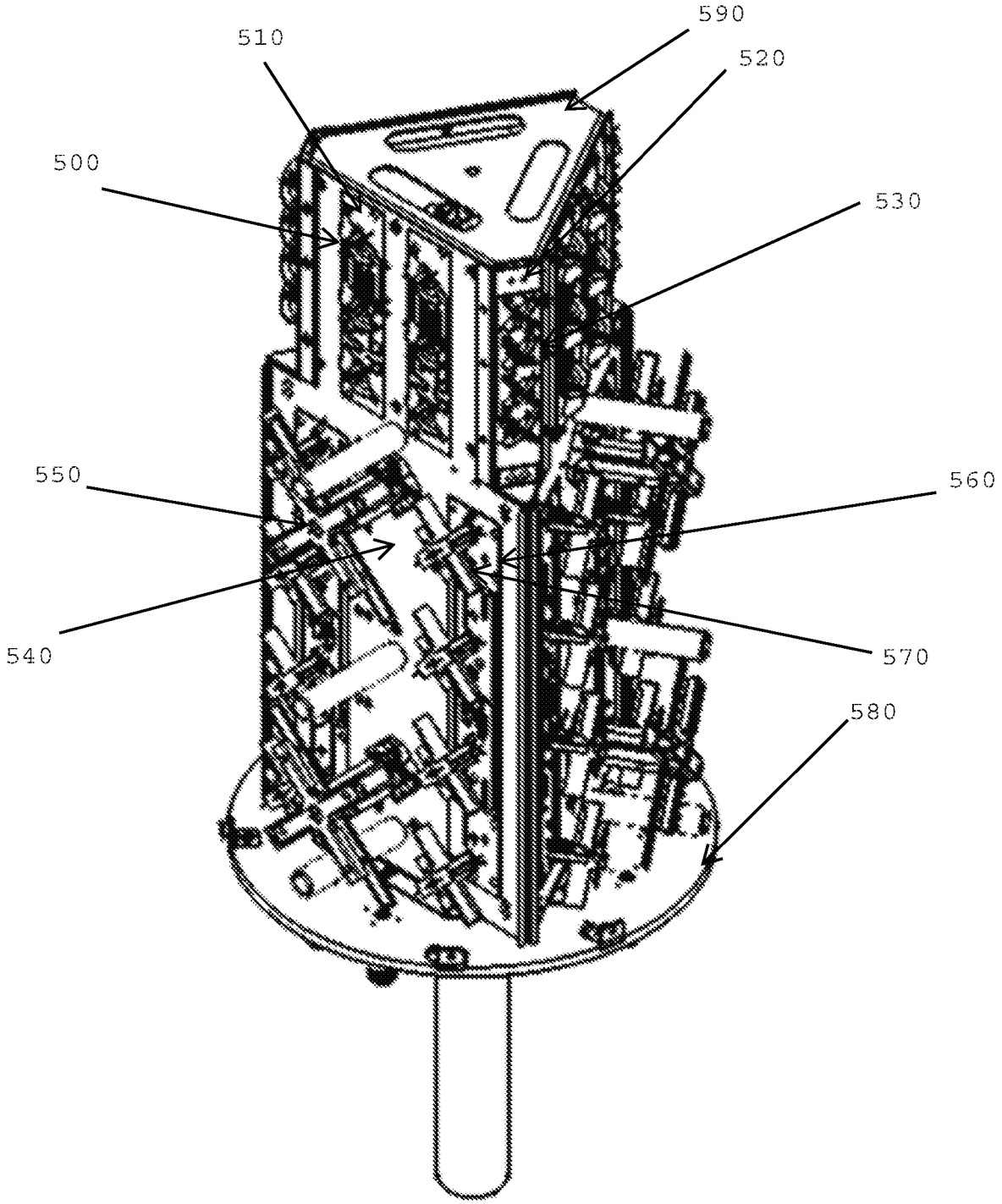
FIG. 7 is a perspective view of a four band antenna array that produces minimal skyward sidelobes.
Figure 8:
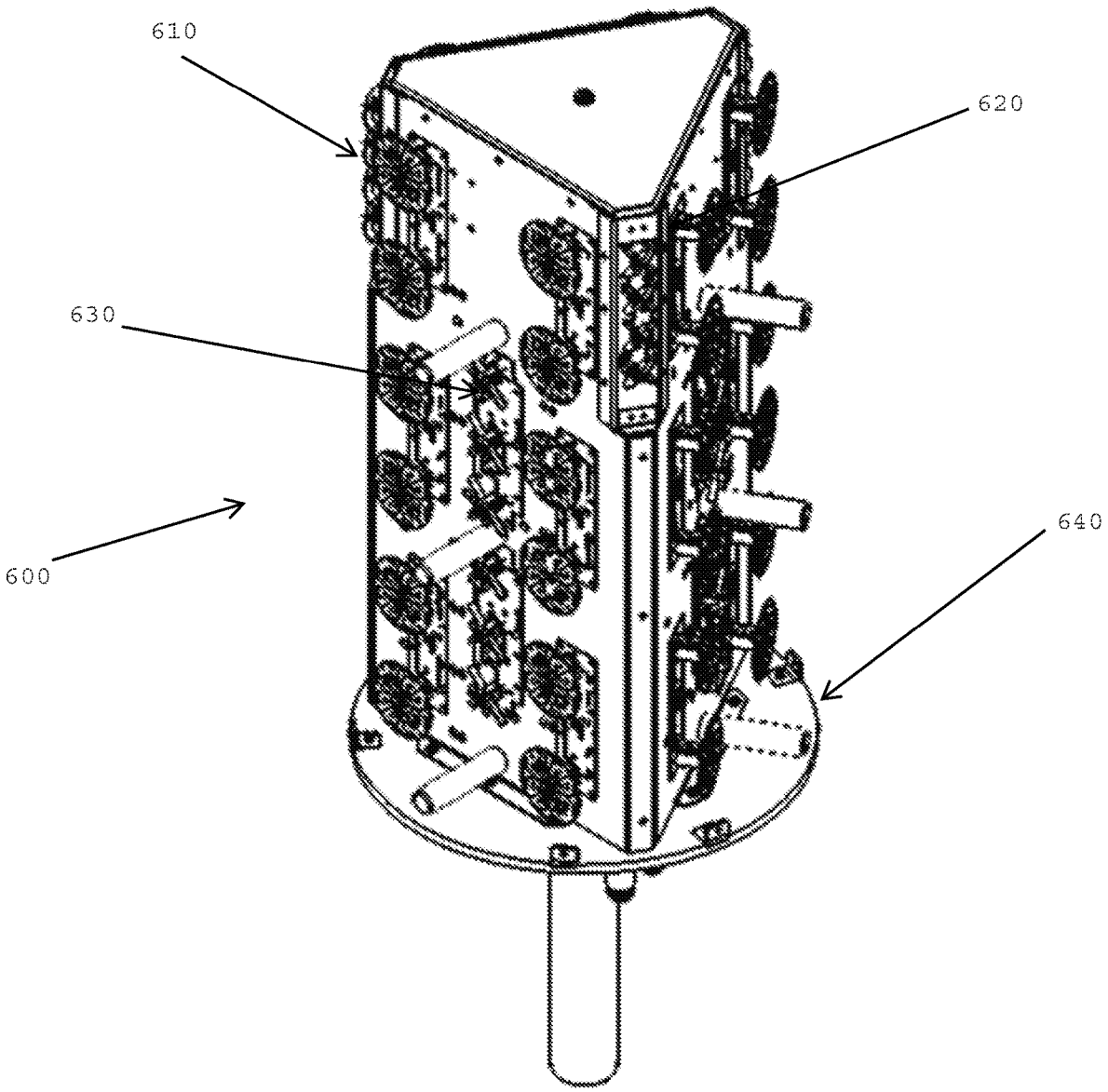
FIG. 8 is a perspective view of a three band antenna array that also produces minimal skyward sidelobes.

Referring to FIGS. 7 and 8, two configurations that provide desirable sidelobe performance are presented. These configurations have been tested to have minimal skyward sidelobe generation.

Referring to FIG. 7, a perspective view of one configuration of a multi-band antenna array is illustrated. In this configuration, a four band antenna array is illustrated with a first frequency band being serviced by first antenna elements 500 arranged on a first reflector 510. The first reflectors are arranged in a first shape and at the corners (i.e. at areas where one first reflector meets another first reflector), a second reflector 520 is mounted. Arranged on the second reflector are second antenna elements 530.

Again referring to FIG. 7, also on the array are third reflectors 540. Arranged on the face of the third reflectors are third antenna elements 550. As can be seen, the third reflectors are arranged in a shape not dissimilar to the first shape. It should, however, be noted that the shape of the arrangement for the third reflectors may be different from the first shape used by the first reflectors. Also present on the array are fourth reflectors 560 and fourth antenna elements 570 arranged on the face of the fourth reflectors 560.

Regarding the placement of the various antenna elements on the antenna array, it should be clear that the first and second antenna elements are placed adjacent one another while the fourth antenna elements and the third antenna elements are adjacent each other. In addition, it should be clear that the antenna array is a multi-level array with the first and second antenna elements being on a first level while the third and fourth antenna elements are on a second level. The second level is located between the first level and a base plate of the antenna array. In other words, as can be seen from FIG. 7, the second antenna elements are above but offset from the third and fourth antenna elements.

In terms of the frequency bands serviced by the various antenna elements, in one implementation, the third antenna elements service the 896-960 MHz band while the fourth antenna elements service the 1695-2690 MHz band. For the same implementation, the second antenna elements service the 5 GHz band (i.e. frequencies from 5150-5925 MHz) and the first antenna elements service the 3550-3700 MHz band.

It has been found that, to achieve the desired sidelobe performance for the 5 GHz antenna subarray, that antenna subarray has to be placed at a corner of the reflectors used for antenna elements servicing a lower frequency band. However, this lower frequency band must not be the lowest frequency band serviced by the antenna array as a whole. Thus, for the implementation in FIG. 7, the 5 GHz subarray cannot be at the corners of the reflectors used by the 896-960 MHz subarray. As such, the 5 GHz subarray (with antenna elements 530) needs to be at a physically higher or different level than the antenna elements for the lower frequency subarray. The level for the 5 GHz subarray is thus between the lower level for the lower frequency subarray and the top 590 of the antenna array as a whole.

Referring to FIG. 8, a three frequency band antenna array embodying the concepts noted above is illustrated. As can be seen, the array 600 has first antenna elements 610 on a first level and second antenna elements 620 on the same level. Third antenna elements 630 are on a second (lower) level. The first reflectors backing the first antenna elements are arranged to form a triangular shape and the second reflectors backing the second antenna elements are placed at the area where the junction between adjacent first reflectors would be present.

For the third reflectors backing the third antenna elements, these reflectors also form a triangular shape. These third reflectors are placed between the first reflectors and the base plate 640 of the antenna array 600 and form a second level for the array. As can be seen in FIG. 8, the boresight of the second antenna elements would form an angle with the boresight of the third antenna elements. These two boresights can be said to be offset or angled relative to one another.

In one specific implementation of the configuration of FIG. 8, the second antenna elements would service the 5 GHz frequency band (5150-5925 MHz) while the first antenna elements would service the 3 GHz frequency band (3400-3800 GHz). The first antenna elements would service the 1695-2690 MHz frequency band.

The configurations in FIGS. 7 and 8 have been tested and have been shown to have minimal sidelobe generation. The 5 GHz antenna in these configurations produce minimal sidelobes skyward.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An antenna array, comprising:

a first plurality of reflectors, each of the first plurality of reflectors having a face, a first edge and a second edge, wherein the first edge of each of the first plurality of reflectors is coupled to the second edge of another of the first plurality of reflectors;

a first plurality of antenna elements arranged on the face of at least one of the first plurality of reflectors, the first plurality of antenna elements configured to radiate within a first frequency band;

a second plurality of reflectors, the second plurality of reflectors mounted to an end of the first plurality of reflectors;

a second plurality of antenna elements arranged on a face of at least one of the second plurality of reflectors, the second plurality of antenna elements configured to radiate within a second frequency band different than the first frequency band;

a third plurality of reflectors, the third plurality of reflectors being mounted on the array such that the third plurality of reflectors are between the first plurality of reflectors and a base plate of the antenna array;

a third plurality of antenna elements, the third plurality of antenna elements being arranged on the face of at least one of the third plurality of reflectors, the third plurality of antenna elements being configured to radiate within a third frequency band different than the first frequency band and the second frequency band;

wherein the first plurality of antenna elements and the second plurality of antenna elements are at a first level of the antenna array and the third plurality of antenna elements are at a second level of the antenna array, the first level being different from the second level and the second level being between the first level and the base plate of the antenna array;

a boresight of said second plurality of antenna elements is at an angle from a boresight of the third plurality of antenna elements.

2. The antenna array according to claim 1, wherein the first plurality of reflectors comprises six reflectors arranged in a hexagonal pattern.

3. The antenna array according to claim 1, wherein the first plurality of reflectors comprises three reflectors arranged in a triangular pattern.

4. The antenna array according to claim 3, wherein the first plurality of antenna elements are arranged on the faces of all three reflectors.

5. The antenna array according to claim 4, wherein the second plurality of antenna elements are arranged on the all three corners of the three reflectors.

6. The antenna array according to claim 1, wherein the second frequency band covers the frequencies in the 5 GHz range and the third frequency band covers frequencies in the 900 MHz range.

7. The antenna array according to claim 6, wherein the second frequency band covers the frequencies 5150-5925 MHz and the third frequency band covers the frequencies 698-960 MHz.

8. The antenna array according to claim 7, wherein the first frequency band covers the frequencies 3400-3800 MHz.

9. The antenna array according to claim 1, wherein a width of each of the first plurality of reflectors is based upon the first frequency band of the first plurality of antenna elements.

10. The antenna array according to claim 1, wherein a width of each of the second plurality of reflectors is based upon one of the first, the second, or the third frequency bands.

11. The antenna array according to claim 1, wherein the first frequency band covers frequencies 3400-3800 MHz, the second frequency band covers frequencies 5150-5925 MHz, and the third frequency band covers frequencies 1695-2690 MHz.

12. The antenna array according to claim 1, wherein said second frequency band is much higher than said third frequency band.

13. The antenna array according to claim 1, wherein the first plurality of antenna elements comprises a first plurality of dual-polarized dipole antennas, the second plurality of antenna elements comprises a second plurality of dual-polarized dipole antennas, and the third plurality of antenna elements comprises a third plurality of dual-polarized dipole antennas.

14. The antenna array according to claim 1, wherein the first frequency band covers frequencies 3400-3800 MHz, the second frequency band covers frequencies 5150-5925 MHz, and the third frequency band covers frequencies 1695-2690 MHz.

15. An antenna array, comprising:

a first plurality of reflectors arranged in a first shape, the shape comprising at least two faces and at least two edges;

a first plurality of dipole antennas arranged on the at least two faces of the first plurality of reflectors, the first plurality of dipole antennas configured to radiate within a first frequency band;

a second plurality of reflectors arranged at the at least two edges of the first plurality of reflectors;

a second plurality of dipole antennas arranged on a face of at least one of the second plurality of reflectors, the second plurality of dipole antennas being configured to radiate within a second frequency band different than the first frequency band;

a third plurality of reflectors arranged in a second shape, the second shape comprising at least two faces and at least two edges;

a third plurality of dipole antennas arranged on a face of at least one of the third plurality of reflectors, the third plurality of dipole antennas configured to radiate within a third frequency band different than the first frequency band and the second frequency band;

wherein the first plurality of antenna elements and the second plurality of antenna elements are at a first level of the antenna array and the third plurality of antenna elements are at a second level of the antenna array, the first level being different from the second level and the second level being between the first level and a base plate of the antenna array;

a boresight of said second plurality of antenna elements is at an angle from a boresight of the third plurality of antenna elements.

16. The antenna array according to claim 15, further comprising a plurality of feed boards galvanically isolated from the first plurality of reflectors, wherein the second plurality of dipole antennas are mounted on the plurality of feed boards.

17. The antenna array according to claim 15, wherein the second frequency band covers the frequencies 5150-5925 MHz and the third frequency band covers the frequencies 698-960 MHz.

18. The antenna array according to claim 15 wherein the first frequency band covers the frequencies 3400-3800 MHz.

19. The antenna array according to claim 15, wherein said second frequency band is much higher than said third frequency band.

* * * * *